US005678490A

United States Patent [19]

Parussatti et al.

[11] Patent Number: 5,678,490

[45] Date of Patent: Oct. 21, 1997

[54] SELF-STEERING RUNNING GEAR FOR RAIL VEHICLES

[75] Inventors: Bruno Parussatti, Candiolo; Roberto Lovaldi, Savigliano; PierLuca Vivalda, Cuneo; Guglielmo Casadei, Turin, all of Italy

[73] Assignee: Fiat Ferroviaria S.p.A., Turin, Italy

[21] Appl. No.: 611,845

[22] Filed: Mar. 8, 1996

[30] Foreign Application Priority Data

Sep. 18, 1995 [IT] Italy ..... TO95A0738

[51] Int. Cl.[6] ..... B61F 5/00

[52] U.S. Cl. ..... 105/167

[58] Field of Search ..... 105/165, 166, 105/167, 168

[56] References Cited

U.S. PATENT DOCUMENTS

| | | | |
|---|---|---|---|
| 278,770 | 6/1883 | Brown | 105/165 |
| 1,728,096 | 9/1929 | Algrain | 105/168 |
| 4,860,666 | 8/1989 | Smith | 105/168 |
| 5,372,073 | 12/1994 | Cattani | 105/165 |

FOREIGN PATENT DOCUMENTS

| | | | |
|---|---|---|---|
| 329440 | 8/1989 | European Pat. Off. | 105/165 |
| 89840 | 5/1870 | France | 105/165 |
| 602731 | 8/1934 | Germany | 105/165 |
| 1920596 | 11/1969 | Germany | 105/166 |
| 324848 | 2/1930 | United Kingdom | 105/165 |

*Primary Examiner*—Mark T. Le

*Attorney, Agent, or Firm*—Sughrue, Mion, Zinn, Macpeak, and Seas

[57] ABSTRACT

A self-steering running gear for rail vehicles includes at least one Bissel-type axle. Through a proper geometrical proportioning of the running gear, the Bissel-type axle is oriented in a perfectly radial condition along a constant radius curve, in a real or in a virtual mode. In both cases perfectly radial orientation along a constant radius curve of at least another steerable axle of the running gear may be operated. Expedients are further provided to reduce the effects deriving from the sum of radiality errors of the axles during the transition phases.

6 Claims, 2 Drawing Sheets

SELF-STEERING RUNNING GEAR FOR RAIL VEHICLES

BACKGROUND OF THE INVENTION

The present invention is generally related to running gears for rail vehicles, and more particularly for tramway vehicles.

The present design trend in the field of such vehicles is to provide self-steering running gears in order to give efficient solutions to the problem of the wheel-rail wear when the vehicle is running along a curve, since these steerable axle of the vehicle may be radially oriented following the curve radius of the track.

Axle steering is performed in some cases spontaneously, but more frequently steering is driven, to the aim of reaching the best possible compromise between the achievement of a perfectly radial orientation along a full curve having a constant radius, and the radiality errors during the entry and exit transitions relative to the curve.

SUMMARY OF THE INVENTION

The general object of the present invention is to provide a new and peculiar solution to the above mentioned problem, by resorting to a running gear configuration which employs at least one Bissel-type steering axle, used as such in the past for instance as a single-axle trailing bogie for locomotives of railway vehicles.

Accordingly, the present invention is directed in particular to a self-steering running gear for rail vehicles, comprising at least two steerable axles having respective journals for pivoted connection thereof relative to a longitudinal structure of the rail vehicle, and a third axle of the Bissel-type connected by an arm to a third pivot journal located on a cantilevered portion of said longitudinal structure, projecting beyond the pivot journal of an adjacent one of said steerable axles.

The specific object of the present invention is to provide a self-steering running gear of the above-referenced type, wherein the or each Bissel axle can be oriented into perfect radiality conditions along a constant radius full curve, independently of the curve radius, and/or can operate steering to a perfectly radial condition along a constant radius full curve, independently of the radius of the curve itself, of at least another steerable axle of the rail vehicle.

A further object of the invention is to achieve the aforesaid goal while reducing the sum of the radiality errors of the rail vehicle axles during the entry and exit transitions relative to the curve, so as to reduce the effects of concentrated wear of the track.

In order to achieve the above objects, the invention is directed to a self-steering running gear of the type set forth in the above, the essential feature of which resides in that, indicating as "2i" the distance between said pivot journals of the two steerable axles, as "a" the distance between said third pivot journal and the pivot journal of the adjacent steerable axles, and as "b" the length of the arm between the Bissel-type axle and the respective third pivot journal, the following relationship is met:

$$a^2+2ai-b^2=0$$

whereby, indicating b/a=n, and P=a+b, it follows:

$$2i=(n^2-1)a=b(n^2-1)/n=P(n-1)$$

By virtue of the novel and peculiar proportioning defined in the above, radial orienting of the Bissel-axle along a constant radius full curve is performed in a simple and efficient way, independently of the value of the radius itself. This allows providing a number of options, including the possibility of actually operating radial steering of the Bissel axle, situated for example at a front leading position or at an intermediate position with reference to the rail vehicle, and in this case reference will be conventionally made to a real (or direct) radial Bissel. In such a case, with the aid of simple kinematic mechanisms, the real radial Bissel may operate at least one further axle of the running gear so as to correspondingly perform perfectly radial orientation thereof along a constant radius full curve. Alternatively, and in that case reference will conventionally be made to a virtual radial Bissel, the Bissel axle may be not operated so as to be oriented perfectly radially along a full curve, but same will anyhow made available an angle signal through which it is possible, by means of simple transmission systems, to operate radial orienting of one or more of the other axles.

The first situation (real radial-Bissel) is corresponding to the case in which the arm, through which the Bissel-axle is connected to the pivot journal of the cantilevered portion of the longitudinal structure of the rail vehicle, is rigidly fixed to the Bissel-axle itself, while in the second case connection between that arm and the Bissel axle is not rigid, but is on the contrary articulated.

The invention does contemplate several alternative configurations of the running gear, for which expedients are also provided for performing a different steering drive of one or more axles, to the aim of reducing the radiality error sums during the entry and exit transitions of the vehicle relative to the curve, so as to correspondingly limit the negative consequences in terms of localized wear of the track.

BRIEF DESCRIPTION OF THE DRAWINGS

Several embodiments of the invention will now be disclosed with reference to the accompanying drawings, purely provided by way of non-limiting example, in which.

DETAILED DESCRIPTION OF THE INVENTION

Figure 1:
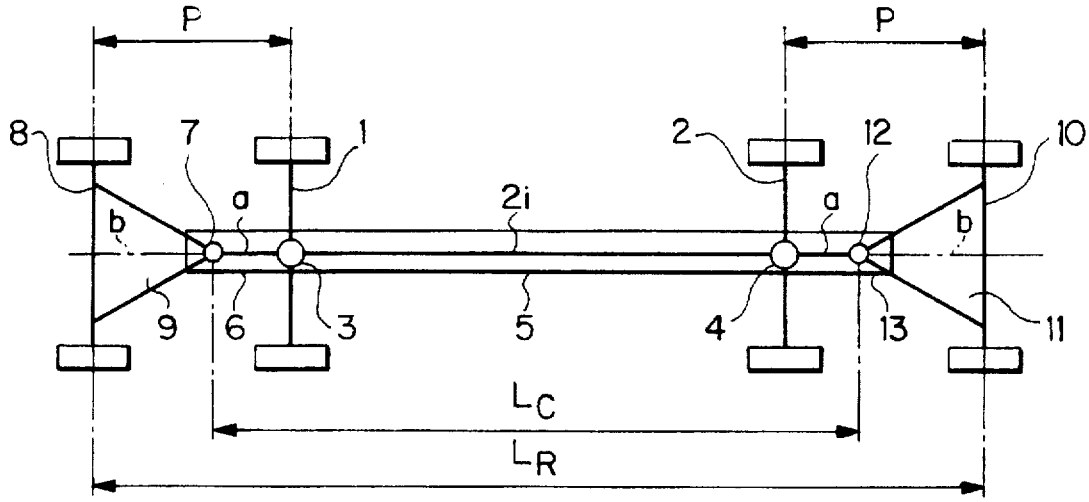
FIG. 1 is a diagrammatic top plan view generally showing a self-steering running gear according to a first embodiment of the invention.

Referring initially to FIG. 1, a running gear for rail vehicles according to a first embodiment of the invention comprises a first axle 1 and a second axle 2 connected in a steerable way, by means of respective central vertical pivot journals 3, 4, to a rigid longitudinal bar structure 5 of the rail vehicle, at spaced-apart locations. The pivot pitch between the two axles 1, 2, i.e. the distance between the respective journals 3, 4, is indicated as 2i.

At one end (the left end with reference to FIG. 1) of the bar 5, a cantilevered portion 6 is projecting beyond the pivot journal 3 of the axle 1. This cantilevered portion 6 carries a vertical journal 7 for pivotal connection of a third axle 8, of the Bissel-bogie type. In the embodiment of FIG. 1 an arm, diagrammatically depicted as 9, is rigidly secured to the Bissel axle 8 and rotatably connects the latter to the pivot journal 7.

The distance between the pivot journals 3 and 7 is indicated as a, and the length of the arm 9 is indicated as b in the figure. The wheel base between the axle 1 and the Bissel axle 8, i.e. the sum of a and b is indicated as P.

According to the invention, the proportioning of the running gear is selected so as to meet the following equation:

$$a^2 2ai - b^2 = 0$$

The above relationship enables to operate steering of the Bissel axle 8 to a perfectly radial condition while the rail vehicle is travelling along a constant radius full curve, independently of the curve radius.

Indicating:

$$b/a = n$$

and $$P = a + b$$

the following is obtained:

$$2i = (n^2 - 1)a = b(n^2 - 1)/n = P(n - 1)$$

i.e.:

$$n = i/b + \sqrt{(i/b)^2 + 1}$$

thus:

$$P = a(n+1) = b(n+1)/n$$

In the embodiment shown in FIG. 1, the running gear comprises a second axle of the Bissel-type indicated as 10, arranged symmetrically at the other end of the bar structure 5 opposite to the Bissel axle 8. Likewise, the second Bissel axle 10 is rigidly connected to an arm 11 whose length is also h and which is pivoted about a vertical journal 12 carried by a cantilevered portion 13 of the bar structure 5 protruding beyond the pivot journal 4 of the axle 2. The distance between the journals 4 and 12 is of the same value a. In this case, taking into account the above relationships, the pitch between the journals 7 and 12 is:

$$L_C = a(n^2+1) = b(n^2+1)/n = P(n^2+1)/(n+1)$$

the distance $L_R$ between the two Bissel axles 8 and 10 is:

$$L_R = a(n+1)^2 = b(n+1)^2/n = P(n+1)$$

When designing a running gear, the starting set data are normally 2i and P. Based upon the preceding relationships, the dimensional values a, b by which perfect radiality along a constant radius full curve of one and/or the other Bissel axle 8, 10 is to be obtained, are immediately calculated.

Figure 2:
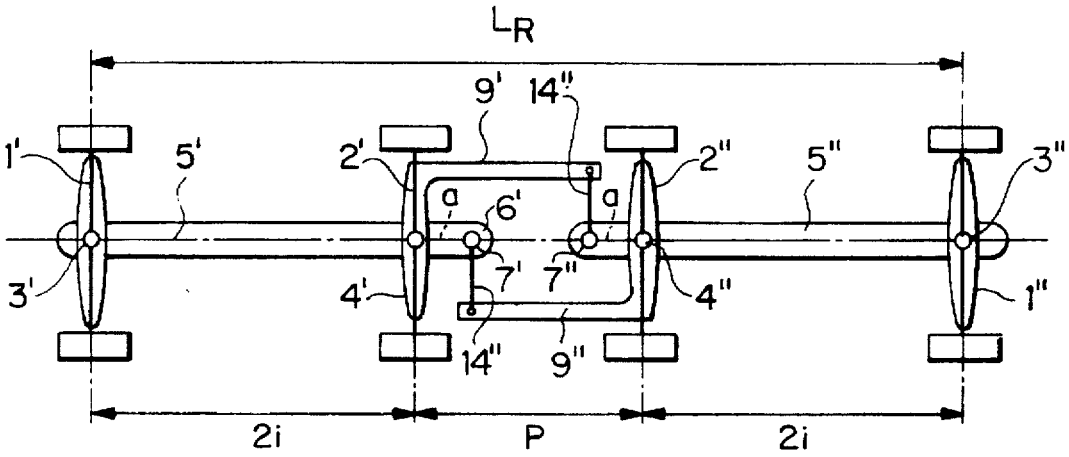
FIG. 2 is a view similar to FIG. 1 showing a second embodiment of the invention.

FIG. 2 shows a variant of the running gear according to the invention, in which the Bissel axles are arranged at an intermediate location, instead than at the ends of the running gear as in the case of FIG. 1. In this embodiment two bar structures 5', 5" are provided, each of which carries in proximity of the respective outer end a respective pivot journal 3', 3" for a respective first steering axle 1', 1", and carries in proximity of the opposite end a respective pivot journal 4', 4" of a respective second steering axle 2', 2'. The inner ends of the bar structures 5', 5" are provided with respective cantilevered portions 6', 6" each carrying a respective pivot journal 7', 7" for a respective connecting rod 14', 14". The connecting rod 14' is pivotally linked to an arm 9" which is rigidly connected to the axle 2" while the connecting rod 14" is pivotally linked to an arm 9' which in turn is rigidly secured to the axle 2'. As it is apparent from FIG. 2, the arrangement of the arms 9' and 9" is symmetrical.

This configuration is conceptually equivalent to the case of the FIG. 1, considering, on one hand, the steerable axles 1' and 2' in combination with the Bissel axle 2", and, on the other hand, the steerable axles 1" and 2" in combination with the Bissel axle 2'.

In this embodiment, considering the values a, b, P and 2i such as indicated in FIG. 2, the following relationship is met in connection with the pivot pitch between the journals 3' and 3" of the end axles 1' and 1":

$$L_R = (P+2)2i = P + 2P(n-1) = P(2n-1)$$

which corresponds to orienting radially the intermediate axles 2' and 2" along a constant radius full curve.

As already previously pointed out, the above relationships leading to perfectly radial orientation along a full curve of the or each Bissel axle of the running gear; enable either to actually operate radial steering along a full curve of the or each Bissel axle itself, and in such a case it will be conventionally provided a real radial Bissel configuration, or, without actually performing radial steering of the or each Bissel axle, to employ the corresponding control signal thereof for perfectly radially steering another axle along a full curve, by means of simple mechanical transmissions systems. In the latter case a configuration conventionally designated as virtual radial Bissel will be carried out.

The diagrams of FIGS. 3 through 7 provide examples of some possible alternative embodiment corresponding to the former and to the latter of the above two modes. In these figures parts which are identical or similar to those already disclosed with reference to FIG. 1 are indicated by the same reference numerals.

Figure 3:
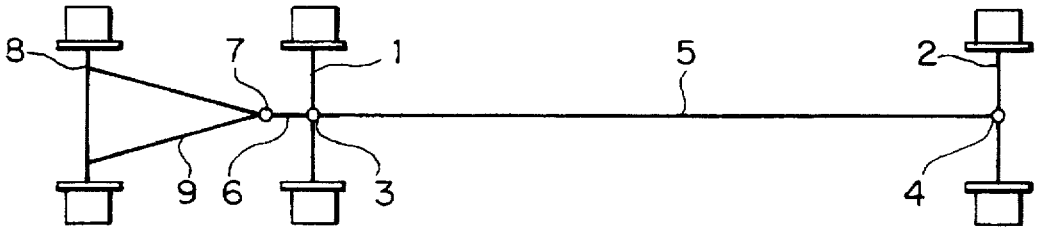
FIG. 3 is a view similar to FIG. 1 showing a third embodiment of the invention.

In detail, the embodiment shown in FIG. 3 corresponds to that of FIG. 1, but with only a single Bissel axle 8, which operates as a leading real radial Bissel.

Figure 4:
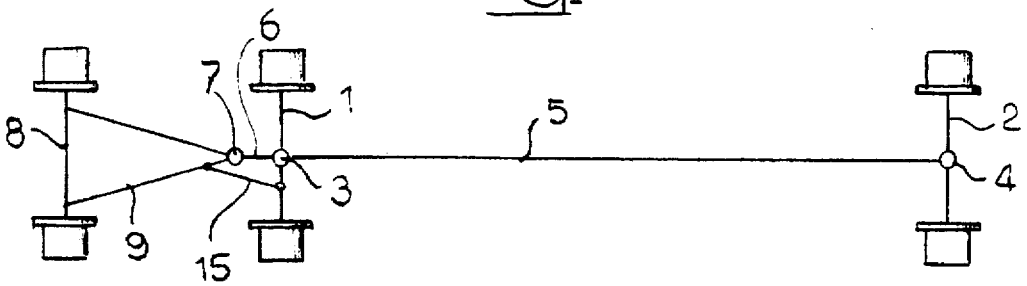
FIG. 4 is a view similar to FIG. 1 showing a fourth embodiment of the invention.

In the embodiment of FIG. 4 the same leading real radial Bissel 8 is additionally acting so as to operate radial orienting along a full curve of the steering axle 1, through a simple articulated transmission arm 15.

Figure 5:
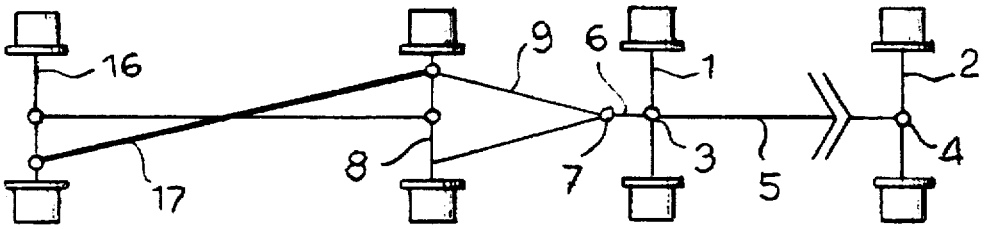
FIG. 5 is a view similar to FIG. 1 showing a fifth embodiment of the invention.

In the embodiment of FIG. 5 the radial Bissel axle 8 is virtual, since the respective arm 9 is pivotally, instead of rigidly, connected to the axle 8. In this case such a virtual radial Bissel axle 8 provides a driving signal for the radial orientation along a full curve of a further steerable axle 16, for instance situated at the leading end of the vehicle, through a simple articulated reversing rod 17 which is pivotally connected to the axle 16 at 22 and to the arm 9 at 23.

Figure 6:
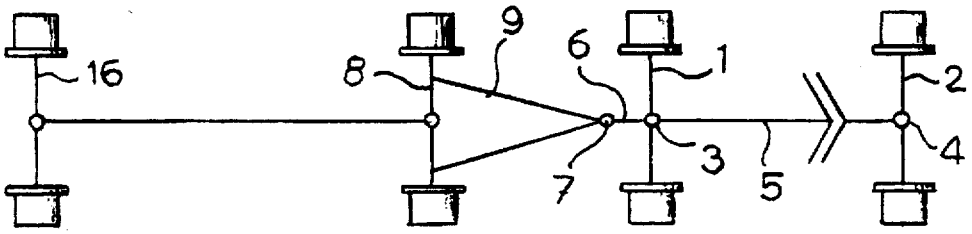
FIG. 6 is a view similar to FIG. 1 showing a sixth embodiment of the invention.

In the embodiment of FIG. 6 the general arrangement is similar to the case of FIG. 5, with the difference that the arm 9 is rigidly connected to the Bissel axle 8, which is situated at an intermediate location and, therefore, is a real radial Bissel.

Figure 7:
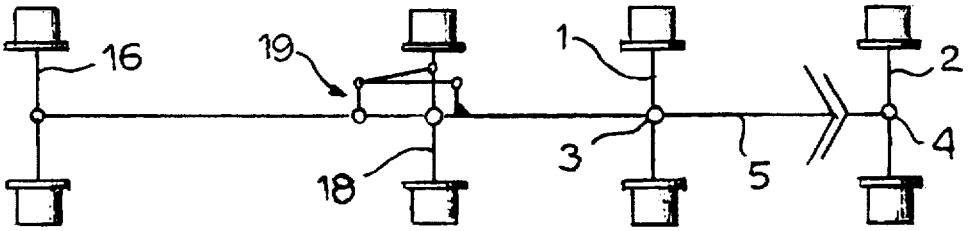
FIG. 7 is a view similar to FIG. 1 showing a seventh embodiment of the invention.

Lastly, the embodiment of FIG. 7, in which the Bissel axle (or axles) is not shown, depicts the case in which steering of one intermediate axle 18 is operated through an ordinary kinematism 19, to the aim of reducing the negative effects on the track deriving from the sum of the radiality errors of the several axles during the entry and exit transitions relative to the curve. Actually, since the arrangement according to the invention by which the condition of perfect radiality of one or more steering axle along a full curve is obtained, may originate radiality errors during those transition phases, it is proper to avoid that these errors be produced identically in respect of all the steering axles, i.e. in correspondence of the same areas of the track. By virtue of the solution corresponding to the embodiment of FIG. 7, and by other functionally similar solutions, it is possible to differentiate the above radiality errors and the consequent negative effects applied by the axles to the track.

Naturally, the details of construction and the embodiments may be widely varied with respect to what has been disclosed and illustrated, without thereby departing from the scope of the present invention, such as defined in the appended claims.

What is claimed is:

1. A self-steering running gear for rail vehicles having a longitudinal structure, said running gear comprising at least two steerable axles having respective pivot journals for pivoted connection of said axles relative to said longitudinal structure, said longitudinal structure having a cantilevered portion projecting beyond the pivot journal of one of said steerable axles and a third pivot journal located on said cantilevered portion, a third axle comprised of a Bissel axle, and arm means connecting said third axle to said third pivot journal, wherein, indicating as "2i" the distance between said pivot journals of said at least two steerable axles, as "a" the distance between said third pivot journal and the pivot journal of said one of said steerable axles, and as "b' the length of said arm means between said Bissel axle and said third pivot journal, the following relationship is met:

$$a^2+2ai-b^2=0$$

whereby, indicated b/a=n, and P=a+b, it follows:

$$2i=(n^2-1)a=b(n^2-1)/n=P(n-1).$$

2. Running gear according to claim 1, wherein said arm means is rigidly connected to said Bissel axle.

3. Running gear according to claim 2, wherein said Bissel axle is operably connected to at least another steerable axle for steering said at least another steerable axle.

4. Running gear according to claim 1, wherein said arm means is connected to said Bissel axle, and said arm means being operably connected to at least another steering axle for steering said at least another steering axle.

5. Running gear according to claim 3, wherein transmission means are connected between said Bissel axle and said at least another steerable axle for steering of said at least another steerable axle.

6. Running gear according to claim 4, wherein transmission means are connected between said Bissel axle and said at least another steering axle for steering of said at least another steering axle.

* * * * *